US009279173B2

(12) United States Patent
Hori et al.

(10) Patent No.: US 9,279,173 B2
(45) Date of Patent: Mar. 8, 2016

(54) ALUMINUM ALLOY FORGED MATERIAL FOR AUTOMOTIVE VEHICLES AND PRODUCTION METHOD FOR THE MATERIAL

(71) Applicant: Kobe Steel, Ltd., Kobe-shi (JP)

(72) Inventors: Masayuki Hori, Inabe (JP); Yoshiya Inagaki, Inabe (JP); Manabu Nakai, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 266 days.

(21) Appl. No.: 13/841,377

(22) Filed: Mar. 15, 2013

(65) Prior Publication Data

US 2013/0255842 A1 Oct. 3, 2013

(30) Foreign Application Priority Data

Mar. 30, 2012 (JP) ..... 2012-081071

(51) Int. Cl.

| | |
|---|---|
| ***C22F 1/05*** | (2006.01) |
| ***C22C 21/08*** | (2006.01) |
| ***C22C 21/04*** | (2006.01) |
| ***C22C 21/00*** | (2006.01) |
| ***C22F 1/047*** | (2006.01) |

(52) U.S. Cl.

CPC . *C22F 1/05* (2013.01); *C22C 21/00* (2013.01); *C22C 21/04* (2013.01); *C22C 21/08* (2013.01); *C22F 1/047* (2013.01)

(58) Field of Classification Search

CPC ..... C22F 1/64; C22C 1/026; C22C 21/00

See application file for complete search history.

(56) References Cited

U.S. PATENT DOCUMENTS

| | | | | |
|---|---|---|---|---|
| 2010/0089503 | A1 | 4/2010 | Inagaki et al. | |
| 2011/0253266 | A1 * | 10/2011 | Bush et al. | 148/550 |
| 2013/0032255 | A1 | 2/2013 | Hori et al. | |

FOREIGN PATENT DOCUMENTS

| | | | |
|---|---|---|---|
| JP | 2001-107168 | A | 4/2001 |
| JP | 2007-177308 | A | 7/2007 |
| JP | 2008-163445 | A | 7/2008 |

OTHER PUBLICATIONS

U.S. Appl. No. 13/800,263, filed Mar. 13, 2013, Hori, et al.
Extended European Search Report issued Nov. 28, 2013 in Patent Application No. 13001479.8.
U.S. Appl. No. 14/191,782, filed Feb. 27, 2014, Hori et al.

* cited by examiner

*Primary Examiner* — Jun Li
*Assistant Examiner* — Jenny Wu
(74) *Attorney, Agent, or Firm* — Oblon, McClelland, Maier & Neustadt, L.L.P.

(57) ABSTRACT

An aluminum alloy forged material for automotive vehicles comprises 0.6~1.2 mass % of Mg, 0.7~1.5 mass % of Si, 0.1.~0.5 mass % of Fe, 0.01~0.1 mass % of Ti, 0.3~1.0 mass % of Mn, at least one of 0.1~0.4 mass % of Cr and 0.05~0.2 mass % of Zr, a restricted amount of Cu that is less than or equal to 0.1 mass %, a restricted amount of Zn that is less than or equal to 0.05 mass %, a restricted amount of H that is less than or equal to 0.25 ml in 100 g Al and a remainder of Al and inevitably contained impurities, and the material includes precipitated crystalline particles among which the largest one has a maximum equivalent circle diameter equal to or less than 8 μm and an area ratio of the precipitated crystalline particles is equal to or less than 3.6%.

2 Claims, 10 Drawing Sheets

Fig. 5

| No. | Alloy Composition (mass%) excluding Remainder of Al and inevitably included impurities | | | | | | | | | |
|---|---|---|---|---|---|---|---|---|---|---|
| | Mg | Si | Fe | Ti | Mn | Cr /Select. | Zr /Select. | Cu | Zn | $H_2$ |
| Claimed Range (%) | 0.6 - 1.2 | 0.7 - 1.5 | 0.1 - 0.5 | 0.01 - 0.1 | 0.3 - 1.0 | 0.1 - 0.4 | 0.05 - 0.2 | ≤0.1 | ≤0.05 | ≤0.25 |
| Work. Example 1 | 1.00 | 0.70 | 0.25 | 0.02 | 0.65 | 0.20 | <0.01 | 0.07 | <0.02 | 0.15 |
| Work. Example 2 | 1.00 | 1.20 | 0.10 | 0.02 | 0.65 | 0.20 | <0.01 | 0.07 | <0.02 | 0.15 |
| Work. Example 3 | 1.00 | 1.20 | 0.45 | 0.02 | 0.65 | 0.20 | <0.01 | 0.07 | <0.02 | 0.15 |
| Work. Example 4 | 1.00 | 1.20 | 0.25 | 0.02 | 1.00 | 0.20 | <0.01 | 0.07 | <0.02 | 0.15 |
| Work. Example 5 | 1.00 | 1.20 | 0.25 | 0.02 | 0.30 | 0.20 | <0.01 | 0.07 | <0.02 | 0.15 |
| Work. Example 6 | 0.60 | 1.20 | 0.25 | 0.02 | 0.65 | 0.20 | <0.01 | 0.07 | <0.02 | 0.15 |
| Work. Example 7 | 1.00 | 1.20 | 0.25 | 0.10 | 0.65 | 0.20 | <0.01 | 0.07 | <0.02 | 0.15 |
| Work. Example 8 | 1.00 | 1.20 | 0.25 | 0.10 | 0.65 | <0.03 | 0.10 | 0.07 | <0.02 | 0.15 |
| Work. Example 9 | 1.00 | 1.20 | 0.25 | 0.02 | 0.65 | 0.20 | 0.15 | 0.07 | <0.02 | 0.15 |
| Work. Example 10 | 1.00 | 1.20 | 0.25 | 0.02 | 0.65 | 0.20 | <0.01 | <0.01 | <0.02 | 0.15 |
| Work. Example 11 | 1.00 | 1.50 | 0.25 | 0.02 | 0.65 | 0.20 | <0.01 | 0.07 | <0.02 | 0.15 |
| Comp. Example 1 | 1.00 | 0.60 | 0.25 | 0.02 | 0.65 | 0.20 | <0.01 | 0.07 | <0.02 | 0.15 |
| Comp. Example 2 | 1.00 | 1.60 | 0.25 | 0.02 | 0.65 | 0.20 | <0.01 | 0.07 | <0.02 | 0.15 |
| Comp. Example 3 | 1.00 | 1.20 | 0.05 | 0.02 | 0.65 | 0.20 | <0.01 | 0.07 | <0.02 | 0.15 |
| Comp. Example 4 | 1.00 | 1.20 | 0.60 | 0.02 | 0.65 | 0.20 | <0.01 | 0.07 | <0.02 | 0.15 |
| Comp. Example 5 | 1.00 | 1.20 | 0.25 | 0.02 | 0.65 | 0.20 | <0.01 | 0.30 | <0.02 | 0.15 |
| Comp. Example 6 | 0.50 | 1.20 | 0.25 | 0.02 | 0.65 | 0.20 | <0.01 | 0.07 | <0.02 | 0.15 |
| Comp. Example 7 | 1.30 | 1.20 | 0.25 | 0.02 | 0.65 | 0.20 | <0.01 | 0.07 | <0.02 | 0.15 |
| Comp. Example 8 | 1.00 | 1.20 | 0.25 | <0.004 | 0.65 | 0.20 | <0.01 | 0.07 | <0.02 | 0.15 |
| Comp. Example 9 | 1.00 | 1.20 | 0.25 | 0.15 | 0.65 | 0.20 | <0.01 | 0.07 | <0.02 | 0.15 |
| Comp. Example 10 | 1.00 | 1.20 | 0.25 | 0.02 | 0.65 | 0.20 | <0.01 | 0.07 | 0.10 | 0.15 |
| Comp. Example 11 | 0.90 | 1.20 | 0.25 | 0.02 | 0.20 | 0.20 | <0.01 | 0.07 | <0.02 | 0.15 |
| Comp. Example 12 | 0.90 | 1.20 | 0.25 | 0.02 | 1.40 | 0.20 | <0.01 | 0.07 | <0.02 | 0.15 |
| Comp. Example 13 | 0.90 | 1.20 | 0.25 | 0.02 | 0.65 | <0.03 | <0.01 | 0.07 | <0.02 | 0.15 |
| Comp. Example 14 | 1.00 | 1.20 | 0.25 | 0.02 | 0.65 | <0.03 | 0.50 | 0.07 | <0.02 | 0.15 |
| Comp. Example 15 | 1.00 | 1.20 | 0.25 | 0.02 | 0.65 | 0.05 | <0.01 | 0.07 | <0.02 | 0.15 |
| Comp. Example 16 | 1.00 | 1.20 | 0.25 | 0.02 | 0.65 | 0.50 | <0.01 | 0.07 | <0.02 | 0.15 |
| Comp. Example 17 | 1.00 | 1.20 | 0.25 | 0.02 | 0.65 | 0.20 | 0.30 | 0.07 | <0.02 | 0.15 |
| Comp. Example 18 | 1.00 | 1.20 | 0.25 | 0.02 | 0.65 | 0.20 | <0.01 | 0.07 | <0.02 | 0.30 |
| Comp. Example 19 | 0.90 | 0.60 | 0.25 | 0.02 | 0.30 | 0.20 | <0.01 | 0.07 | <0.02 | 0.30 |
| Comp. Example 20 | 1.10 | 1.55 | 0.25 | 0.02 | 1.00 | 0.20 | <0.01 | 0.07 | <0.02 | 0.30 |
| Comp. Example 21 | 0.50 | 1.60 | 0.25 | 0.02 | 0.65 | 0.20 | <0.01 | 0.07 | <0.02 | 0.30 |

Fig.6

| No. | Max. Equiv. Circ. Diam. of Prec. Cryst. Particles (μm) | Area Ratio (%) | Mechanical Properties (Average Values) | | | Sensit. to SCC |
|---|---|---|---|---|---|---|
| | | | Tensile Strength (MPa) | 0.2% Yield Strength (MPa) | Elong. (%) | |
| Criterion for acceptance | ≤8μm | ≤3.6% | ≥420 | ≥370 | ≥10.0 | |
| Work. Example 1 | 3 | 2.0 | 425 | 389 | 18.9 | Excellent |
| Work. Example 2 | 3 | 1.4 | 443 | 414 | 18.5 | Good |
| Work. Example 3 | 7 | 3.0 | 438 | 410 | 15.9 | Excellent |
| Work. Example 4 | 8 | 3.6 | 440 | 411 | 10.9 | Good |
| Work. Example 5 | 4 | 2.1 | 452 | 424 | 17.4 | Good |
| Work. Example 6 | 4 | 2.3 | 422 | 395 | 15.7 | Good |
| Work. Example 7 | 5 | 2.6 | 438 | 411 | 14.6 | Excellent |
| Work. Example 8 | 4 | 2.4 | 442 | 415 | 15.1 | Excellent |
| Work. Example 9 | 5 | 2.1 | 433 | 400 | 16.1 | Excellent |
| Work. Example 10 | 4 | 2.5 | 435 | 412 | 14.7 | Excellent |
| Work. Example 11 | 7 | 2.9 | 468 | 441 | 14.3 | Good |
| Comp. Example 1 | 2 | 1.9 | 413 | 378 | 19.3 | Excellent |
| Comp. Example 2 | 6 | 3.0 | 455 | 423 | 12.5 | No good |
| Comp. Example 3 | 3 | 1.5 | 400 | 377 | 20.0 | Excellent |
| Comp. Example 4 | 10 | 4.4 | 428 | 402 | 9.5 | Good |
| Comp. Example 5 | 4 | 2.6 | 451 | 426 | 16.0 | No good |
| Comp. Example 6 | 4 | 2.3 | 411 | 380 | 17.6 | No good |
| Comp. Example 7 | 9 | 2.9 | 445 | 420 | 4.3 | Good |
| Comp. Example 8 | 3 | 2.5 | 419 | 388 | 7.4 | No good |
| Comp. Example 9 | 14 | 2.8 | 433 | 401 | 6.4 | Good |
| Comp. Example 10 | 4 | 2.6 | 417 | 381 | 16.2 | No good |
| Comp. Example 11 | 3 | 2.0 | 386 | 360 | 16.6 | No good |
| Comp. Example 12 | 11 | 4.6 | 439 | 415 | 6.4 | Good |
| Comp. Example 13 | 4 | 2.0 | 391 | 377 | 16.1 | No good |
| Comp. Example 14 | 6 | 2.6 | 416 | 392 | 4.2 | Good |
| Comp. Example 15 | 4 | 2.1 | 395 | 381 | 15.8 | No good |
| Comp. Example 16 | 23 | 3.2 | 422 | 398 | 4.5 | No good |
| Comp. Example 17 | 4 | 2.6 | 428 | 400 | 9.4 | Good |
| Comp. Example 18 | 4 | 2.4 | 402 | 398 | 9.0 | Excellent |
| Comp. Example 19 | 3 | 1.9 | 388 | 365 | 21.2 | Good |
| Comp. Example 20 | 8 | 3.6 | 415 | 402 | 9.1 | No good |
| Comp. Example 21 | 11 | 3.8 | 404 | 388 | 6.6 | No good |

Fig.7A

| No. | Melting and Casting Process | Homogenizing Heat Treatment Process | | | | First Heating Process | | Extruding Process | | |
|---|---|---|---|---|---|---|---|---|---|---|
| | Cast. Temp. (℃) | Temp. Rising Speed (℃/min) | Temp. (℃) | Treat. Time (hour) | Cooling speed (℃/min) | Heat. Temp. (℃) | Heat. Time (hour) | Extr. Temp. (℃) | Extr. Ratio | Extr. Speed (m/min) |
| Claimed Range | 700 - 780 | ≥1.0 | 470 - 560 | 3 - 12 | ≤2.5 (≤300° | 500 - 560 | ≥0.75 | 450 - 540 | 15 - 25 | 1 - 15 |
| Work. Example 12 | 700 | 3 | 560 | 4 | 3 | 540 | 1.5 | 500 | 20 | 5 |
| Work. Example 13 | 720 | 3 | 540 | 8 | 10 | 500 | 1.5 | 500 | 20 | 5 |
| Work. Example 14 | 720 | 3 | 540 | 10 | 6 | 540 | 1.5 | 500 | 20 | 5 |
| Work. Example 15 | 720 | 2 | 560 | 4 | 3 | 540 | 2.0 | 500 | 20 | 5 |
| Work. Example 16 | 720 | 5 | 540 | 8 | 6 | 560 | 1.5 | 500 | 20 | 5 |
| Work. Example 17 | 780 | 1 | 500 | 12 | 3 | 500 | 1.5 | 500 | 20 | 5 |
| Comp. Example 22 | 680 | | | | | | | | | |
| Comp. Example 23 | 850 | | | | | | | | | |
| Comp. Example 24 | 800 | 3 | 540 | 8 | 3 | 540 | 1.5 | 500 | 20 | 5 |
| Comp. Example 25 | 720 | 0.8 | 540 | 8 | 3 | 540 | 1.5 | 500 | 20 | 5 |
| Comp. Example 26 | 720 | 0.2 | 540 | 8 | 3 | 540 | 1.5 | 500 | 20 | 5 |
| Comp. Example 27 | 720 | 6 | 540 | 8 | 3 | 540 | 0.5 | 500 | 20 | 5 |
| Comp. Example 28 | 720 | 3 | 450 | 8 | 3 | 540 | 1.5 | 500 | 20 | 5 |
| Comp. Example 29 | 720 | 3 | 580 | 8 | 3 | 540 | 1.5 | 500 | 20 | 5 |
| Comp. Example 30 | 720 | 3 | 540 | 1 | 3 | 540 | 1.5 | 500 | 20 | 5 |
| Comp. Example 31 | 720 | 3 | 540 | 8 | 15 | 540 | 0.3 | 500 | 20 | 5 |
| Comp. Example 32 | 720 | 3 | 540 | 8 | 0.8 | 540 | 1.5 | 500 | 20 | 5 |
| Comp. Example 33 | 720 | 3 | 540 | 8 | 3 | 450 | 1.5 | 500 | 20 | 5 |
| Comp. Example 34 | 720 | 3 | 540 | 8 | 3 | 580 | 1.5 | 500 | 20 | 5 |
| Comp. Example 35 | 720 | 3 | 540 | 8 | 3 | 520 | 1.5 | 400 | 20 | 5 |
| Comp. Example 36 | 720 | 3 | 540 | 8 | 3 | 560 | 1.5 | 550 | 20 | 5 |
| Comp. Example 37 | 720 | 3 | 540 | 8 | 3 | 540 | 1.5 | 500 | 10 | 5 |
| Comp. Example 38 | 720 | 3 | 540 | 8 | 3 | 540 | 1.5 | 500 | 35 | 5 |
| Comp. Example 39 | 720 | 3 | 540 | 8 | 3 | 540 | 1.5 | 500 | 20 | 0.5 |
| Comp. Example 40 | 720 | 3 | 540 | 8 | 3 | 540 | 1.5 | 500 | 20 | 17 |
| Comp. Example 41 | 720 | 3 | 540 | 8 | 3 | 540 | 1.5 | 500 | 20 | 5 |
| Comp. Example 42 | 720 | 3 | 540 | 8 | 3 | 540 | 1.5 | 500 | 20 | 5 |
| Comp. Example 43 | 720 | 3 | 540 | 8 | 3 | 540 | 1.5 | 500 | 20 | 5 |
| Comp. Example 44 | 720 | 3 | 540 | 8 | 3 | 540 | 1.5 | 500 | 20 | 5 |
| Comp. Example 45 | 720 | 3 | 540 | 8 | 3 | 540 | 1.5 | 500 | 20 | 5 |
| Comp. Example 46 | 720 | 3 | 540 | 8 | 3 | 540 | 1.5 | 500 | 20 | 5 |
| Comp. Example 47 | 720 | 3 | 540 | 8 | 3 | 540 | 1.5 | 500 | 20 | 5 |
| Comp. Example 48 | 720 | 3 | 540 | 8 | 3 | 540 | 1.5 | 500 | 20 | 5 |
| Comp. Example 49 | 720 | 3 | 540 | 8 | 3 | 540 | 1.5 | 500 | 20 | 5 |
| Comp. Example 50 | 720 | 3 | 540 | 8 | 3 | 540 | 1.5 | 500 | 20 | 5 |
| Comp. Example 51 | 720 | 3 | 540 | 8 | 3 | 540 | 1.5 | 500 | 20 | 5 |
| Comp. Example 52 | 720 | 3 | 540 | 8 | 3 | 540 | 1.5 | 500 | 20 | 5 |
| Comp. Example 53 | 720 | 3 | 540 | 8 | 3 | 540 | 1.5 | 500 | 20 | 5 |

Fig.7B

| No. | Second Heating Proc. | | Forging Proc. | | Solution Treatment Process | | Quen. Proc. | Artificial Age. Treat. Process | |
|---|---|---|---|---|---|---|---|---|---|
| | Heat. Temp. (°C) | Heat. Time (hour) | Start Temp. (°C) | End Temp. (°C) | Solut. Temp. (°C) | Solut. Time (hour) | Temp. (°C) | Age. Temp. (°C) | Age. Time (hour) |
| Claimed Range | 500 - 560 | ≥0.75 | 450 - 560 | ≥400 | 500 - 560 | 3 - 8 | ≤60 | 160 - 220 | 3 - 12 |
| Work. Example 12 | 540 | 1.0 | 500 | 460 | 555 | 6 | 45 | 200 | 3 |
| Work. Example 13 | 500 | 1.0 | 480 | 425 | 540 | 8 | 60 | 175 | 8 |
| Work. Example 14 | 540 | 1.0 | 500 | 460 | 540 | 8 | 60 | 175 | 8 |
| Work. Example 15 | 540 | 1.0 | 540 | 480 | 560 | 3 | 60 | 160 | 12 |
| Work. Example 16 | 560 | 1.0 | 560 | 500 | 500 | 8 | 40 | 180 | 5 |
| Work. Example 17 | 500 | 1.0 | 450 | 400 | 520 | 5 | 40 | 180 | 5 |
| Comp. Example 22 | | | | | | | | | |
| Comp. Example 23 | | | | | | | | | |
| Comp. Example 24 | 520 | 1.0 | 500 | 440 | 540 | 8 | 60 | 175 | 8 |
| Comp. Example 25 | 520 | 1.0 | 500 | 440 | 540 | 8 | 60 | 175 | 8 |
| Comp. Example 26 | 520 | 1.0 | 500 | 440 | 540 | 8 | 60 | 175 | 8 |
| Comp. Example 27 | 520 | 1.0 | 500 | 440 | 540 | 8 | 60 | 175 | 8 |
| Comp. Example 28 | 520 | 1.0 | 500 | 440 | 540 | 8 | 60 | 175 | 8 |
| Comp. Example 29 | 520 | 1.0 | 500 | 440 | 540 | 8 | 60 | 175 | 8 |
| Comp. Example 30 | 520 | 1.0 | 500 | 440 | 540 | 8 | 60 | 175 | 8 |
| Comp. Example 31 | 520 | 1.0 | 500 | 440 | 540 | 8 | 60 | 175 | 8 |
| Comp. Example 32 | 520 | 1.0 | 500 | 440 | 540 | 8 | 60 | 175 | 8 |
| Comp. Example 33 | 520 | 1.0 | 500 | 440 | 540 | 8 | 60 | 175 | 8 |
| Comp. Example 34 | 520 | 1.0 | 500 | 440 | 540 | 8 | 60 | 175 | 8 |
| Comp. Example 35 | 520 | 1.0 | 500 | 440 | 540 | 8 | 60 | 175 | 8 |
| Comp. Example 36 | 520 | 1.0 | 500 | 440 | 540 | 8 | 60 | 175 | 8 |
| Comp. Example 37 | 520 | 1.0 | 500 | 440 | 540 | 8 | 60 | 175 | 8 |
| Comp. Example 38 | 520 | 1.0 | 500 | 440 | 540 | 8 | 60 | 175 | 8 |
| Comp. Example 39 | 520 | 1.0 | 500 | 440 | 540 | 8 | 60 | 175 | 8 |
| Comp. Example 40 | 500 | 1.0 | 500 | 440 | 540 | 8 | 60 | 175 | 8 |
| Comp. Example 41 | 600 | 1.0 | 500 | 440 | 540 | 8 | 60 | 175 | 8 |
| Comp. Example 42 | 470 | 1.0 | 500 | 440 | 540 | 8 | 60 | 175 | 8 |
| Comp. Example 43 | 540 | 0.5 | 500 | 440 | 540 | 8 | 60 | 175 | 8 |
| Comp. Example 44 | 540 | 1.0 | 430 | 385 | 540 | 8 | 60 | 175 | 8 |
| Comp. Example 45 | 590 | 1.0 | 580 | 520 | | | | | |
| Comp. Example 46 | 520 | 1.0 | 500 | 440 | 450 | 8 | 60 | 175 | 8 |
| Comp. Example 47 | 520 | 1.0 | 500 | 440 | 600 | 8 | 60 | 175 | 8 |
| Comp. Example 48 | 520 | 1.0 | 500 | 440 | 540 | 10 | 60 | 175 | 8 |
| Comp. Example 49 | 520 | 1.0 | 500 | 440 | 540 | 8 | 90 | 175 | 8 |
| Comp. Example 50 | 520 | 1.0 | 500 | 440 | 540 | 8 | 60 | 120 | 8 |
| Comp. Example 51 | 520 | 1.0 | 500 | 440 | 540 | 8 | 60 | 250 | 8 |
| Comp. Example 52 | 520 | 1.0 | 500 | 440 | 540 | 8 | 60 | 175 | 0.5 |
| Comp. Example 53 | 520 | 1.0 | 500 | 440 | 540 | 8 | 60 | 175 | 30 |

Fig.8

| No. | Max. Equiv. Circ. Diam. of Prec. Cryst. Particles (μm) | Area Ratio (%) | Mechanical Properties (Average Values) | | | Sensit. to SCC | Remark |
|---|---|---|---|---|---|---|---|
| | | | Tensile Strength (MPa) | 0.2% Yield Strength (MPa) | Elong. (%) | | |
| Criterion for acceptance | ≦8μm | ≦3.6% | ≧420 | ≧370 | ≧10.0 | | |
| Work. Example 12 | 7 | 3.4 | 428 | 401 | 15.5 | Excellent | |
| Work. Example 13 | 6 | 3.1 | 431 | 407 | 14.6 | Excellent | |
| Work. Example 14 | 8 | 3.2 | 447 | 425 | 13.7 | Excellent | |
| Work. Example 15 | 6 | 2.8 | 431 | 416 | 14.8 | Good | |
| Work. Example 16 | 7 | 3.4 | 422 | 396 | 13.3 | Excellent | |
| Work. Example 17 | 8 | 3.2 | 425 | 403 | 16.5 | Excellent | |
| Comp. Example 22 | | | | | | | Cannot be cast |
| Comp. Example 23 | | | | | | | Cannot be cast |
| Comp. Example 24 | 12 | 4.3 | 402 | 385 | 6.6 | Good | |
| Comp. Example 25 | 8 | 3.2 | 418 | 396 | 15.9 | Good | |
| Comp. Example 26 | 7 | 3.4 | 396 | 376 | 17.2 | No good | |
| Comp. Example 27 | 6 | 3.3 | 387 | 364 | 17.8 | No good | |
| Comp. Example 28 | 9 | 3.7 | 388 | 368 | 18.0 | Good | |
| Comp. Example 29 | 5 | 2.9 | 421 | 399 | 7.8 | No good | |
| Comp. Example 30 | 11 | 4.4 | 402 | 378 | 10.1 | No good | |
| Comp. Example 31 | 6 | 3.5 | 387 | 364 | 16.3 | Good | |
| Comp. Example 32 | 7 | 3.4 | 422 | 399 | 15.5 | No good | |
| Comp. Example 33 | 7 | 3.6 | 391 | 367 | 16.6 | No good | |
| Comp. Example 34 | 5 | 2.7 | 400 | 395 | 6.4 | No good | Eutectic Melting |
| Comp. Example 35 | 5 | 3.1 | 384 | 362 | 19.4 | No good | |
| Comp. Example 36 | | | | | | | Cracked on Extrusion |
| Comp. Example 37 | 8 | 3.6 | 403 | 377 | 13.4 | Excellent | |
| Comp. Example 38 | 5 | 3.0 | 435 | 411 | 12.4 | No good | |
| Comp. Example 39 | 6 | 3.2 | 380 | 364 | 15.9 | No good | |
| Comp. Example 40 | 5 | 3.1 | 404 | 387 | 7.6 | Excellent | |
| Comp. Example 41 | 6 | 3.4 | 399 | 390 | 4.7 | Excellent | |
| Comp. Example 42 | 7 | 3.4 | 385 | 361 | 18.2 | No good | |
| Comp. Example 43 | 7 | 3.4 | 392 | 382 | 13.0 | No good | |
| Comp. Example 44 | 5 | 3.3 | 386 | 364 | 17.8 | No good | |
| Comp. Example 45 | | | | | | | Forging Crack |
| Comp. Example 46 | 9 | 3.8 | 410 | 391 | 15.6 | Good | |
| Comp. Example 47 | 5 | 2.8 | 396 | 387 | 3.8 | No good | |
| Comp. Example 48 | 6 | 3.4 | 389 | 374 | 18.4 | No good | |
| Comp. Example 49 | 7 | 3.4 | 414 | 391 | 14.5 | Excellent | |
| Comp. Example 50 | 7 | 3.5 | 408 | 365 | 15.7 | No good | |
| Comp. Example 51 | 7 | 3.4 | 412 | 402 | 12.2 | Excellent | |
| Comp. Example 52 | 7 | 3.4 | 388 | 350 | 16.8 | No good | |
| Comp. Example 53 | 7 | 3.3 | 387 | 369 | 10.1 | Excellent | |

ALUMINUM ALLOY FORGED MATERIAL FOR AUTOMOTIVE VEHICLES AND PRODUCTION METHOD FOR THE MATERIAL

CROSS REFERENCE TO RELATED APPLICATIONS

This application claims the foreign priority benefit under 35 U.S.C. §119 of Japanese Patent Application No. 2012-081071 filed on Mar. 30, 2012, the disclosure of which is incorporated herein by reference.

FIELD OF THE INVENTION

The present invention relates to an aluminum alloy forged material to be used for automotive structural members inclusive of automotive vehicle underbody members and its production method.

DESCRIPTION OF THE RELATED ART

Aluminum alloys such as 6000 series materials (Al—Mg—Si alloys) standardized in JIS or AA have been used for structural parts of cars, ships, airplanes, motor cycles and automotive vehicles. These 6000 series aluminum alloys have relatively good corrosion resistance and a good recycling property of used materials of these alloys being easily reused.

Aluminum casting materials and aluminum alloy forged materials are often used for automotive vehicle structural parts which are in relatively complicated shapes, because these parts are produced at a relatively low cost with these materials. Of these materials, the aluminum alloy forged material is mainly used for structural parts such as automotive vehicle underbody members like upper arms and lower arms, which need high strength and high toughness. The aluminum alloy forged material is produced the following way. A homogenizing heat treatment is performed on the cast aluminum alloy material and the cast aluminum alloy is hot-forged by mechanical forging or oil pressure forging. Then tempering treatment of solution treatment, quenching treatment and artificial ageing treatment (hereinafter referred to as "ageing treatment") is performed on the forged material.

In recent years, requirements for the automotive vehicle structural parts to be made lighter and thinner have been increased due to the increased trend for low fuel consumption and low carbon dioxide emission. So far, aluminum alloy forged materials of such as 6061 and 6151 in 6000 series aluminum alloys have been used for the automotive vehicle structural parts. However these aluminum alloy forged materials do not have sufficiently good performance on their strengths. Moreover it should be noted that the aluminum alloy forged materials to be applied to various automotive vehicle members need to have good practically sufficient corrosion resistance.

Therefore, JP2007-177308A discloses on extruding material of a 6000 series aluminum alloy which has high strength and high toughness.

However, since the aluminum alloy extruding material described in a JP 2007-177308A contains a relatively large amount of Cu, this material is likely not to have good corrosion resistance though its strength is relatively high.

The present invention has been completed under the circumstances, and its objective is to provide an aluminum alloy forged material that has not only high tensile strength but also good corrosion resistance, and a production method for the material.

The inventors of the present invention have investigated both the composition and the production process conditions of the aluminum alloy forged material and tried to find an effective way to improve the properties of the aluminum alloy forged material.

The inventors have found that the tensile strength of the aluminum alloy forged material correlates with the micro crystal structure in the aluminum alloy forged material. Especially, since fracture often originates from a recrystallized portion, a large proportion of the recrystallized portion in the aluminum alloy forged material usually leads to a decrease in the tensile strength. Therefore it is necessary to keep the material from being recrystallized or the recrystallized grains from growing larger if recrystallization occurs.

A process of extrusion processing has been one of the methods to adjust a shape of the aluminum alloy forged material so for. However the inventors of the present invention have investigated the tensile properties of several aluminum alloys that are cast and then extruded before being forged with various extrusion ratios. As a result, the inventors have found that as the extrusion ratio becomes higher, the tensile strength becomes larger by an unexpected large amount. The inventors have considered that one reason for this phenomenon is that the micro crystal structure of the material becomes oriented in the extension direction.

Furthermore the inventors have considered that precipitated crystalline particles included in a cast material are deformed, broken and made finer precipitated crystalline particles when a cast material is extruded at a high extrusion ratio and that the entire crystal structure is modified as a result. The inventors have considered that this unexpectedly large increase in the tensile strength may result from the recrystallization being suppressed by the precipitated crystalline particles having become finer and the entire crystal structure having been modified, although the precipitated crystalline particles are cores for recrystallization and help progress the recrystallization in the conventional production methods.

The inventors have investigated conditions other than the extrusion condition in the extrusion process, under which the tensile strength is likely to become larger and which include a temperature, a time and a cooling speed in the homogenizing process, a temperature of a forged material at the end of the forging process and condition on heating processes before and after the extrusion process.

In addition, the inventors have investigated an alloy composition suited for the extruding processing, assuming that extruding is performed. In general, adding Cu and Zn as well as Mg and Si which are basic strengthening elements contributes to increasing strengths of aluminum alloys. However, since Cu and Zn have an effect of significantly lowering the corrosion resistance of the aluminum alloys, it is difficult to increase an amount of Cu and Zn in the aluminum alloy for the present invention. Then, the inventors have found a method to suppress recrystallization of the aluminum alloy by decreasing the amount of Cu and Zn to as small an amount as possible, instead having a predetermined amount of such transition elements as Mn and Fe, and controlling a grain size and an area ratio of the precipitated crystalline particles and an aluminum alloy forged material which is produced through the method and has a high strength with practically sufficient corrosion resistance.

The aluminum alloy forged material of an embodiment has both high strength and good corrosion resistance which it has been difficult for the aluminum alloy to have at the same time and has been completed by performing an extrusion process and other processes of specific process conditions on an aluminum alloy of a developed composition, based on the above mentioned knowledge obtained through the investigations performed by the inventors.

SUMMARY OF THE INVENTION

In order to solve the objective above mentioned, the aluminum alloy forged material for automotive vehicles of the present invention has features that the material comprises 0.6~1.2 mass % of Mg, 0.7~1.5 mass % of Si, 0.1~0.5 mass % of Fe, 0.01~0.1 mass % of Ti, 0.3~1.0 mass % of Mn, at least one of 0.1~0.4 mass % of Cr and 0.05~0.2 mass % of Zr, a restricted amount of Cu that is less than or equal to 0.1 mass %, a restricted amount of Zn that is less than or equal to 0.05 mass %, a restricted amount of H that is less than or equal to 0.25 ml in 100 g Al and a remainder of Al an inevitable contained impurities, said that the material includes precipitated crystalline particles among which a largest precipitated crystalline particle has a maximum equivalent circle diameter equal to or less than 8 μm and has a tensile strength larger than or equal to 420 MPa, and an area ratio of the precipitated crystalline particles is equal to or less than 3.6%.

Since the aluminum alloy forged material having these features includes predetermined amounts of Si, Mg and Fe and a relatively large amount of transition metals especially such as Mn, the crystal structure of the aluminum alloy forged material becomes fine and have an increased tensile strength. Moreover, the aluminum alloy forged material having this feature includes restricted amounts of Cu and Zn, has lower sensitivity to grain boundary corrosion and is capable of having good corrosion resistance.

Furthermore, the aluminum alloy forged material for automotive vehicles of the present invention has a tensile strength larger than or equal to 420 MPa due to its controlled crystal structure in which the largest precipitated crystalline particle has the maximum equivalent circle diameter less than or equal to 8 μm and the area ratio of the precipitated crystalline particles is equal to or less than 3.6%.

In addition, the production method of the present invention for the aluminum alloy forged material has a feature that the production method includes the following processes to be carried out in the order in which the processes are described, a melting and casting process of melting the aluminum alloy having the composition as described above to a melting temperature between 700° C. and 780° C. and casting the melted aluminum alloy to an ingot, a homogenizing heat treatment process of heating the ingot at a temperature rising speed that is equal to or higher than 1.0° C. /minute, keeping the ingot between 470° C. and 500° C. for 3~12 hours and cooling the ingot to a temperature lower than or equal to 300° C. at a temperature lowering speed equal to or higher than 2.5° C./minute, a first heating process of heating the ingot between 500° C. and 560° C. for more than 0.75 hours, an extruding process of extruding the ingot at an extrusion speed of 1~15 m/minute and at an extrusion ratio between 15 and 25 to an extruded material while a temperature of the ingot is between 450° C. and 540° C., a second heating process of heating the extruded material between 500° C. and 560° C. for more than 0.75 hours, a forging process of forging the extruded material that is heated to a forging start temperature between 450° C. and 560° C. to a forged material in a desired shape at a forging end temperature higher than or equal to 400° C., a solution treatment process of performing a solution treatment of heating the forged material at a solution treatment temperature between 500° C. and 560° C. for 3~8 hours, a quenching process of quenching the forged material at a quenching temperature lower than or equal to 60° C. and an artificial ageing treatment process of keeping the forged material at an ageing temperature between 160° C. and 220° C. for 3~12 hours. The production method of the present invention for the aluminum alloy forged material has each of the processes whose process conditions are strictly controlled. As a result, the production method enables producing the aluminum alloy forged material having micro metal structure, in which the maximum equivalent circle diameter of precipitated crystalline particles is less than or equal to 8 μm and the area ratio of the precipitated crystalline particles is less than or equal to 3.6%, and a tensile strength larger than or equal to 420 MPa.

The aluminum alloy forged material for automotive vehicles has a high tensile strength, a high 0.2% yield strength and a large elongation while having good corrosion resistance. The production method for the aluminum alloy forged material for automotive vehicles enables producing the aluminum alloy forged material for automotive vehicles having a high tensile strength and good corrosion resistance as well.

BRIEF DESCRIPTION OF THE DRAWINGS

FIG. 5 shows a table indicating alloy compositions of the aluminum alloys of the working examples and the comparison examples.

FIG. 6 shows a table indicating measured properties of the aluminum alloy forged materials of working examples and comparison samples.

FIGS. 7A, 7B show a table indicating production conditions for the aluminum alloy forged materials of the working examples and the comparison examples.

FIG. 8 shows a table indicating measured properties of the aluminum alloy forged materials of working examples and comparison examples.

DETAILED DESCRIPTION OF THE EMBODIMENT

Figure 1:
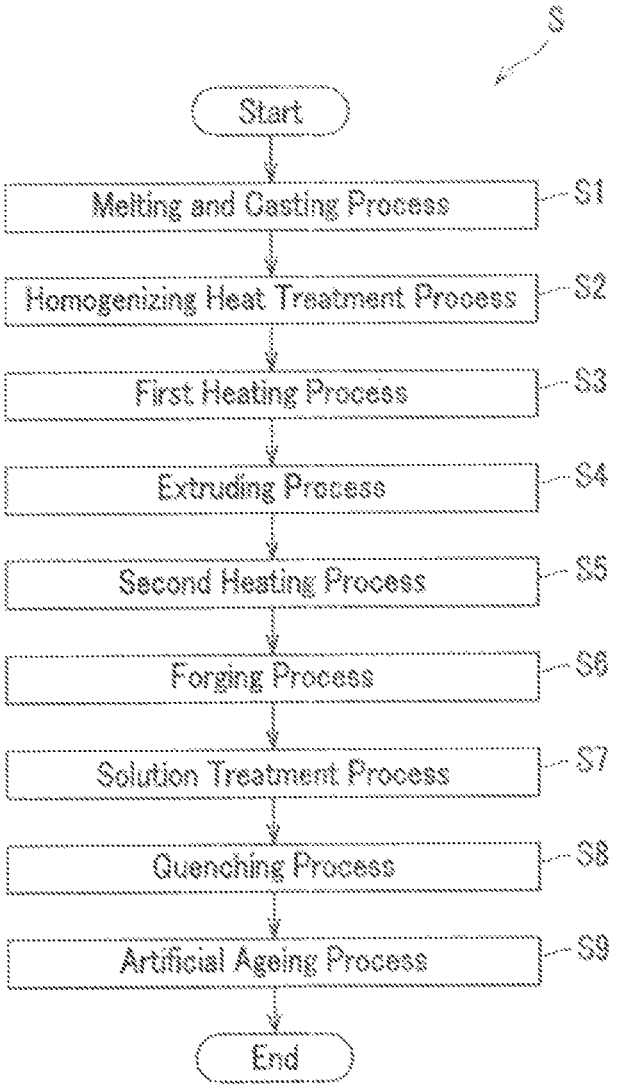
FIG. 1 is a flow chart indicating processes for a production method for the aluminum alloy forged material for automotive vehicles of an embodiment.

Hereinafter the aluminum alloy forged material for automotive vehicles and the production method for the material are explained in detail.

The aluminum alloy of an embodiment comprises 0.6~1.2 mass % of Mg, 0.7~1.5 mass % of Si, 0.1~0.5 mass % of Fe, 0.01~0.1 mass % of Ti, 0.3~1.0 mass % of Mn, at least one of 0.1~0.4 mass % of Cr and 0.05~0.2 mass % of Zr, a restricted amount of Cu that is less than or equal to 0.1 mass %, a restricted amount of Zn that is lees than or equal to 0.05 mass %, a restricted amount of H that is less than or equal to 0.25 ml in 100 g Al and a remainder of Al and inevitably included contained impurities.

Each element included in the aluminum alloy of the present embodiment is explained as follows.

(Mg: 0.6~0.2 Mass %)

Mg is combined with Si to form $Mg_2Si$ (β' phase) which precipitates during the artificial ageing treatment. The precipitation of $Mg_2Si$ crystals contributes to increasing the strength (yield stress) of the aluminum alloy forged material which is a final product to be used. Therefore Mg is indispensable for strengthening the aluminum alloy of the present embodiment. If a content of Mg is lower than 0.6 mass %, an age-hardening effect of the aluminum alloy lowers. On the other hand, if the amount of Mg is higher than 1.2 mass %, the ingot has so high a strength (yield strength) that the ingot becomes difficult to be forged. Moreover, a large amount of $Mg_2Si$ crystals tends to precipitate during a quenching process after the solution treatment. As a result, an average grain size of precipitated crystalline particles of $Mg_2Si$ or Al—Fe—Si—(Mn, Cr) intermetallic compound that are formed at grain boundaries becomes so large that an average distance between the precipitated crystalline particles cannot be made larger. It is preferable to have the average grain size of the precipitated crystalline particles of $Mg_2Si$ or Al—Fe—Si—(Mn, Cr) intermetallic compound smaller than or equal to 1.2 μm and to have the average distance between the precipitated crystalline particles larger than or equal to 3.0 μm. In addition, the content of Mg is preferably between 0.7 mass % and 1.1 mass % and more preferably between 0.8 mass % and 1.0 mass %.

(Si: 0.7~1.5 Mass %)

Si is combined with Mg to form $Mg_2Si$ (β' phase, β" phase) which precipitates during the artificial ageing treatment. The precipitation of $Mg_2Si$ crystals contributes to increasing the strength (yield stress) of the aluminum alloy forged material which is a final product to be used. If a content of Si is less than 0.7 mass %, the resultant aluminum alloy material does not have a sufficiently high strength after the artificial ageing treatment. On the other hand, if the content of Si is more than 1.5 mass %, coarse grains of Si which are either crystallized and precipitate both during the quenching process after the solution treatment and during a casting process and the resultant aluminum alloy does not have good corrosion resistance and a high toughness. Moreover, if too much Si is contained in the aluminum alloy, the average distance between precipitated crystalline particles of $Mg_2Si$ or Al—Fe—Si—(Mn, Cr) intermetallic compound that are formed at grain boundaries cannot be made larger. Accordingly, too much Si lowers the corrosion resistance and the toughness of the aluminum alloy forged material, which is the case with Mg above mentioned.

Moreover, if the content of Si is more than 1.5 mass %, an elongation of the aluminum alloy lowers, which makes a forging process of the aluminum alloy difficult. It is preferable to have the average grain size of the precipitated crystalline particles of $Mg_2Si$ or Al—Fe—Si—(Mn, Cr) intermetallic compound smaller than or equal to 1.2 μm and to have the average distance between the precipitated crystalline particles larger than or equal to 3.0 μm. It should be noted that knowledge of the average grain size and the average distance between grains of the precipitated crystalline particles of Al—Fe—Si—(Mn, Cr) intermetallic compound is described in JP2001-107168A. The content of Si is preferably between 0.9 mass % and 1.4 mass % and more preferably between 1.0 mass % and 1.3 mass %.

(Fe: 0.1~0.5 Mass %)

Fe, which is included in the aluminum alloy as an impurity, is combined with other elements in the aluminum alloy to have such Al—Fe—Si—(Mn, Cr) intermetallic compound crystals as those of $Al_7Cu_2Fe$, $Al_{12}(Fe, Mn)_3Cu_2$ and (Fe, Mn)$Al_6$ precipitated. These precipitated crystalline particles lower a fracture toughness and a fatigue strength of the aluminum alloy forged material, which has been already explained. Especially, if a content of Fe in the aluminum alloy becomes higher than 0.5 mass % or, more strictly speaking, than 0.3 mass %, it is difficult to keep an area ratio of the total precipitated crystalline particles of the Al—Fe—Si—(Mn, Cr) intermetallic compound to a unit area less than or equal to 1.0%. As a result, it is difficult to obtain out of the aluminum alloy an aluminum alloy forged material having higher strength and higher toughness both required of the automotive vehicle use structural material. It should be noted knowledge of the area ratio of the precipitated crystalline particles of the Al—Fe—Si—(Mn, Cr) intermetallic compound is explained in JP2008-163445A. The content of Fe is preferably between 0.2 mass % and 0.4 mass % and more preferably between 0.2 mass % and 0.3 mass %.

(Ti: 0.01~0.1 Mass %)

Ti is added to the aluminum alloy to make crystal grains finer to improve workability of the ingot in the extruding, rolling and forging processes. However, if a content of Ti is less than 0.01 mass %, the crystal grains does not become sufficiently fine and the effect of the better workability of the ingot is not obtained. On the other hand, if the content of Ti is higher than 0.1 mass %, coarse precipitated crystalline particles are formed and the workability of the ingot tends to lower. The content of Ti is preferably between 0.01 mass %, and 0.08 mass % and more preferably between 0.02 mass % and 0.05 mass %.

(Mn: 0.3~0.1 Mass %)

Mn is combined with Al to form dispersed particles of such an intermetallic compound as $Al_6Mn$ both during a homogenizing heat treatment process and during a subsequent hot gorging process. These dispersed particles have an effect of preventing grain boundaries from moving while recrystallization is under way. However, if a content of Mn in the aluminum alloy is less then 0.3 mass %, the effect is not sufficient. On the other hand, if the content of Mn is higher than 1.0 mass %, coarse precipitated crystalline particles are formed and both the workability and the toughness of the aluminum alloy become worse. The content of Mn is preferably between 0.5 mass % and 0.9 mass % and more preferably between 0.6 mass % and 0.8 mass %.

(At Least One of 0.1~0.4 Mass % of Cr and 0.05~0.2 Mass % of Zr)

These elements contribute to generating dispersed particles (dispersed phase) Al6Mn intermetallic compound, Al—Cr intermetallic compounds such as Al12Mg2Cr and Al—Zr intermetallic compounds which precipitate mainly during the homogenizing heat treatment process and during the subsequent hot forging process. Since these dispersed particles have an effect of preventing grain boundaries from moving while recrystallization is under way, fine crystal grains or fine hypo-crystal grains are obtained. Therefore, it is necessary to have at least one of 0.1~0.4 mass % of Cr and 0.05~0.2 mass % of Zr contained in the aluminum alloy. Whether the aluminum alloy contains either Cr or Zr, or both Cr and Zr, a content of Cr should not be higher than the upper limit of 0.4 mass % and a content of Zr should not be higher than the upper area of 0.2 mass %.

If the content of one of these elements is less than needed, the above mentioned effect is not obtained. On the other hand, if the content of one of these elements is higher than its upper limit as explained, coarse crystals of an intermetallic compound such as an Al—Fe—Si—(Mn, Cr) intermetallic compound are easily formed and become an origin for fracture and a cause for lowering the yield strength, the toughness and the fatigue strength of the aluminum alloy. Moreover if the content of one of these elements is more than its upper limit as explained, it is not possible to have a total area ratio of the Al—Fe—Si—(Mn, Cr) intermetallic compound to the unit area leas than or equal to 1.5%, preferably 1.0%, which results in being unable to have an aluminum alloy with a high strength and a high toughness.

The content of Cr is preferably between 0.1. and 0.3 mass % and more preferably between 0.2 and 0.3 mass %. The content of Zr is preferably between 0.08 and 0.2 mass % and more preferably between 0.1 and 0.2 mass %.

(Cu: Less Than or Equal to 0.1 Mass %)

Cu significantly increases sensitivities to stress corrosion cracking and grain boundary corrosion of the aluminum alloy forged material and lowers the corrosion resistance and the durability of the aluminum alloy forged material. Taking this effect into consideration, the present embodiment restricts an amount of Cu contained in the aluminum alloy to as small an amount as possible. However, since as small an amount of Cu as less than or equal to 0.1 mass % of Cu is inevitably contained in the aluminum alloy during the production process and does not significantly affect the properties of the aluminum alloy, the present embodiment restricts the amount of Cu contained in the aluminum alloy to less than or equal to 0.1 mass %.

(Zn: Less Than or Equal to 0.05 Mass %)

If Zn is combined with Mg to form the particles of $MgZn_2$ precipitate in a high density in the aluminum alloy during the artificial ageing treatment, the aluminum alloy possibly has a high tensile strength. However, Zn has an effect of lowering a corrosion potential of the aluminum alloy, which results in the corrosion resistance of the aluminum alloy becoming worse. Moreover, addition of Zn decreases the amount of the precipitated $Mg_2Si$ because Zn is combined with Mg. As a result, the addition of Zn leads to the tensile strength of the aluminum alloy becoming lower. Therefore the present embodiment restricts an amount of Zn to less than or equal to 0.5 mass %.

(H: Less Than or Equal to 0.25 ml in 100 g Al)

Hydrogen ($H_2$) has an effect of significantly lowering the strength and the toughness of the aluminum alloy especially when the aluminum alloy is not intensely wrought through such a working process as the forging process, because hydrogen remains in the aluminum alloy and a bubble of hydrogen becomes an origin for fracture. Hydrogen seriously affects structural materials that are highly strengthened and used for transportation cars. Therefore the present embodiment restricts an amount of hydrogen to less than or equal to 25 ml in 100 g of the Aluminum alloy. It is possible to decrease the amount of hydrogen to less than or equal to 0.25 ml in 100 g Al try using a continuous degassing device and flowing argon, nitrogen, chlorine or the like in the melted aluminum alloy before the melted aluminum alloy is cast to have the melted aluminum alloy bubble.

(Inevitably Contained Impurities)

Elements such as C, Ni, Na, Ca and V are inevitably contained in the aluminum alloy and as small an amount of these elements as not to affect the property of the aluminum alloy is permitted to be included in the aluminum alloy forged material of the present embodiment. To be specific, an amount of each of these elements has to be less than or equal to 0.3 mass % and a total amount of these elements has to be 1.0 mass %.

(Precipitated Crystalline Particle)

Precipitated crystalline particles in the aluminum alloy forged material of the present embodiment need to have a maximum diameter less than or equal to 8 μm if they are approximated to be in circle shapes and an area ratio less than or equal to 3.6%. The precipitated crystalline particles in the present embodiment include fine crystallized precipitates such as precipitated crystalline particles of Al—Si—(Fe, Mn) intermetallic compound and precipitated crystalline particles of $Mg_2Si$ (β' phase). Specific examples of the precipitated crystalline particles of Al—Si—(Fe, Mn) intermetallic compound are AlSiMn, AlSi(Fe, Mn) etc. These precipitated crystalline particles are produced in an ingot, remain after the homogenizing heat treatment process and the forging process, become cores from which recrystallization starts during the forging process and during the solution treatment process and facilitate the recrystallization. If particles of these precipitated crystalline particles exist in the aluminum alloy, the strength of the aluminum alloy after forged is not high. Therefore it is necessary to keep an amount of the precipitated crystalline particles formed in the aluminum alloy as small as possible and the precipitated crystalline particles as fine as possible not to have precipitated crystalline particles having large diameters.

Figure 4:
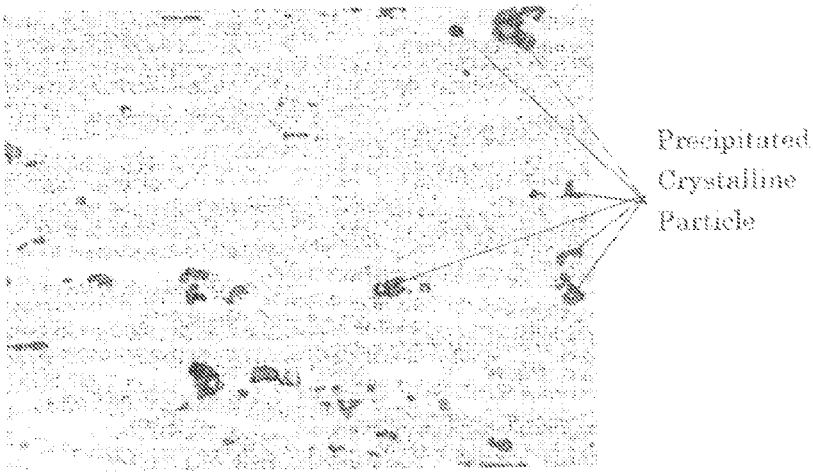
FIG. 4 is a photo showing a micro crystal structure observed on a cross section of the aluminum alloy forged material after forged and especially how precipitated crystalline particles exist and are dispersed.

The size of a precipitated crystalline particle is represented by an equivalent circle diameter. A specific measurement method to measure the size of a precipitated crystalline particle is as follows. Firstly, an aluminum alloy forged material is cut at a portion in which a gravity center of the forged material is and a center portion on the cut surface is etched with Keller Liquid for 30 seconds. Then a photo having a magnification of 400 times is taken of the center portion on the cut surface with a optical microscope. One example of the taken photos of the precipitated crystalline particles is shown in FIG. 4. As seen in FIG. 4, each of the precipitated crystalline particles which are seen black is no an irregular shape. Image analysis is made on the precipitated crystalline particles on the photo and a size of a precipitated crystalline particle is approximated to be a diameter of a circle having an area equivalent to that of the precipitated crystalline particle.

It is necessary to have a maximum equivalent circle diameter of the precipitated crystalline particles less than or equal to 8 μm. If there is a precipitated crystalline particle whose equivalent circle diameter is more than 8 μm, this precipitated crystalline particle is likely to be an origin for fracture and the strength of the aluminum alloy lowers. The maximum equivalent circle diameter of the precipitated crystalline particles is preferably less than or equal to 5 μm and more preferably less than or equal to 3 μm.

In addition, an amount of the precipitated crystalline particles formed in the aluminum alloy is represented by such a parameter as an area ratio of the precipitated crystalline particles. A specific measurement method to measure the area ratio is as follows. Firstly, an aluminum alloy forged material is cut at a portion in which a gravity center of the forged material is and a center portion on the cut surface is etched with Keller Liquid for 30 seconds. Then a photo having a magnification of 400 times is taken of the center portion on the cut surface with a optical microscope. One example of the taken photos at the precipitated crystalline particles is shown in FIG. 4. As seen in FIG. 4, each of the precipitated crystalline particles which are seen black is in an irregular shape. Image analysis is made on all the precipitated crystalline particles and an area for the precipitated crystalline particles on the photo is obtained and the area ratio is calculated as a ratio of the obtained area to an area of the whole image.

The area ratio of the precipitated crystalline particles need to be less than or equal to 3.6%. If the area ratio becomes higher than 3.6%, there exist a lot of portions in the aluminum alloy, from which fracture originates when the aluminum alloy is tensioned, and the strength of the aluminum alloy lowers as a result. The area ratio of the precipitated crystalline particles is preferably less than or equal to 3.0% and more preferably less than or equal to 2.5%.

As has been explained, the aluminum alloy forged material of the present embodiment is made of the aluminum alloy having the composition above explained, and has the maximum equivalent circle diameter of the precipitated crystalline particles less than or equal to 8 μm and the area ratio of the precipitated crystalline particles less than or equal to 3.6%. As a result, the aluminum alloy forged material of the present embodiment is capable of having a tensile strength more than or equal to 420 MPa.

Next, a production method of the aluminum alley forged material for automotive vehicles of the present embodiment is to be explained.

FIG. 1 shows a flow chart for a production method S for the aluminum alloy forged material of the present embodiment. As is shown in FIG. 1, the production method S of the present embodiment comprises a melting and casting process S1, a homogenizing heat treatment process S2, a first heating process S3, an extruding process S4, a second heating process S5, a forging process S6, a solution treatment process S7, a quenching process S8 and an artificial ageing treatment process S9, which are to be carried out in this order. In order to obtain the aluminum alloy forged material of the present embodiment having a high tensile strength and a good corrosion resistance, the aluminum alloy need not only have the composition above explained, but also be processed on the production method in accordance with predetermined conditions.

In the production method of the aluminum alloy forged material, ordinary conditions may be taken for other processes than the following processes to be explained. Each process of the production method S is explained hereinafter.

(Melting and Casting Process)

In the melting and casting process S1, the melted aluminum alloy having the chemical composition above mentioned is cast into an ingot. An ordinary casting method such as a continuous casting method (for example, Hot-top casting method) and a semi-continuous casting method (DC casting method), whichever is appropriate for the process, may be used. The ingot may be in any shape such as a round bar shape or a slab shape. There is no restriction on the shape of the ingot.

In the melting and casting process S1, the temperature of the melted aluminum alloy before cast has to be between 700° C. and 780° C. If the temperature of the aluminum alloy before cast is below 700° C., the temperature of the melted aluminum alloy easily becomes lower than a solidification temperature of the aluminum alloy and the casting process has to stop because the melted aluminum alloy easily solidifies in a tundish and a casting nozzle becomes clogged with the solidified metal. On the other hand, if the melted aluminum alloy is above 780° C., the melted aluminum alloy does not easily solidify and continuous casting has to be stopped because a bleeding phenomenon in which a solidified shell is broken happens during the continuous casting process.

In order to produce an ingot having fine crystal grains, a smaller average particle size of precipitated crystalline particles of Al—Fe—Si—(Mn, Cr) intermetallic compound which are formed between crystal grains and a larger average distance between the precipitated crystalline particles, it is preferable to have the melted aluminum alloy cooled as quick as possible.

(Homogenizing Heat Treatment Process)

The homogenizing heat treatment process S2 is a process in which a predetermined homogenizing heat treatment is performed on the cast ingot. The ingot needs to be heated at a temperature rising speed equal to or higher than 1.0° C./minute and kept between 470° C. and 560° C. for 3 to 12 hours and then cooled to lower than or equal to 300° C. at a temperature lowering speed equal to or more than 2.5° C./minute.

The temperature rising speed needs to be more than or equal to 1.0° C./minute and if it is less than 1.0° C./minute, the ingot is likely to have coarse precipitated Mg—Si particles and an unhomogenous crystal structure in which dispersed particles are disposed around each of the coarse precipitated Mg—Si particles and recrystallization easily occurs. If the temperature rising speed is more than or equal to 10° C./minute, coarse dispersed particles are likely to be formed and recrystallization easily occurs and therefore the temperature rising speed is preferably less than 10° C./minute.

An objective of the homogenizing heat treatment is to have dispersed particles as small as 5~500 nm densely precipitated. When fine dispersed particles are densely precipitated in the crystal structure, movement of grain boundaries can be efficiently suppressed and recrystallization can be suppressed accordingly. An efficient temperature range for the homogenizing heat treatment is between 470° C. and 560° C. and preferably between 480° C. and 540° C. If the homogenizing heat treatment is performed at a temperature outside the range between 470° C. and 560° C., there are not as many dispersed particles precipitated as to have a sufficient effect of suppressing recrystallization or dispersed particles become too coarse to sufficiently suppress recrystallization. If the homogenizing heat treatment is performed for less than 3 hours, it is difficult to have as many dispersed particles precipitated over the entire ingot as needed because the entire ingot is not sufficiently heat treated. The homogenizing heat treatment is performed preferably for less than or equal to 12 hours, taking productivity into account.

It is necessary to cool the ingot to lower than or equal to 300° C. at the temperature lowering speed equal to or more than 2.5° C./minute. If the ingot is cooled to lower than or equal to 300° C. at the temperature lowering speed less than 2.5° C./minute, coarse precipitated crystalline particles of $Mg_2Si$ are formed during the cooling process and recrystallization is not sufficiently suppressed during the subsequent extruding process and both an effect of strengthening and an effect of dispersed particles are reduced. Moreover, the workability of the ingot become worse. The homogenizing heat treatment process may be performed in any appropriate furnace of, an air furnace, an induction nesting furnace and a salt bath.

(First Heating Process)

The first heating process S3 is a necessary process to smoothly extrude the ingot in the subsequent extruding process S4.

It is necessary to heat the ingot between 500° C. and 560° C. for more than or equal to 0.75 hours in the first heating process S3. If the heating temperature is below 500° C., the above mentioned effect is not obtained. If the heating temperature is above 560° C., there are voids due to eutectic melting left inside the ingot and the ingot cannot be extruded smoothly. If the heating time is less than 0.75 hours, a center portion in the ingot cannot be sufficiently heated and the above mentioned effect cannot be obtained. The heating time is preferably not more than 6 hours to keep unchanged the dispersed particles formed in the homogenizing heat treatment process.

(Extruding Process)

In the production method of the present invention, the extruding process S4 in which the ingot is extruded is performed after the first healing process S3. The ingot has a fiber like structure after extruded, which contributes to preferably increasing the tensile strength and the toughness.

The extruding process is performed at an extrusion speed of 1~15 m/minute and at an extrusion ratio of 15~25 to an extruded material while the temperature of the extruding ingot is between 450° C. and 540° C.

If the temperature of the ingot is below 450° C., deformation resistance is so large that there is a large work-strain left in a resultant extruded material and that recrystallization easily occurs during the subsequent solution treatment process S7, which results in a decrease in the tensile strength of the forged material. If the temperature of the ingot is above 540° C., recrystallization occurs at a surface portion of the material and the effect of increasing the tensile strength is hardly obtained.

The extrusion ratio indicates a change ratio between a cross section area of a material before extruded and a cross section area of an extruded material. Accordingly the extrusion ratio is obtained by measuring an area of a cross section of the material that is vertical to an extruding direction before and after the extruding process and dividing the area of the cross section before the extruding process by the area of the cross section after the extruding process. If the ingot is extruded at the extrusion ratio less than 15, the extruded material does not have a sufficiently fiber-like metal structure in which precipitated crystalline particles are made finer and modified and recrystallization easily occurs in this extruded material, which results in the tensile strength of the extruded material being not significantly increased.

On the other hand, if the ingot is extruded at the extrusion ratio over 25, the extruded material has so large an amount of work-strain left therein that recrystallization easily occurs and that the tensile strength does not become higher and can decrease instead.

If the ingot is extruded at the extrusion speed less than 1 m/minute, the temperature of the ingot to be extruded lowers and it becomes difficult to extrude the ingot. If the ingot is extruded at the extrusion speed more than 15 m/minute, friction on the surface of the ingot is so large that the ingot being extruded becomes heated and that recrystallization occurs, which leads to the tensile strength of the resultant product being not significantly increased.

(Second Heating Process)

The second heating process S5 is needed to decrease the work-strain left after the extruding process and the deformation resistance against forging deformation in the forging process S6. The second heating process S5 is performed to optimize the forging process and a heating temperature in the second heat treatment process needs to be equal to or higher than that of the forging process S6.

It is necessary to heat the ingot between 500° C. and 560° C. for more than or equal to 0.75 hours in the first heating process S5. If the heating temperature is below 500° C., the above mentioned effect is not obtained. If the heating temperature is above 560° C., there are voids due to eutectic melting left inside the ingot and the ingot cannot be extruded smoothly. If the heating time is less than 0.75 hours, a center portion in the ingot cannot be sufficiently heated and the above mentioned effect cannot be obtained. The heating time is preferably not more than 6 hours to keep unchanged the dispersed particles formed in the homogenizing heat treatment process.

(Forging Process)

The forging process S6 is a process in which hot forging with mechanical forging or oil pressure forging is performed on the extruded material used as a forging material and the extruded material is forged to a forged material in a predetermined shape. In this forging process S6, a forging start temperature of the forging material when the forging process gets started should be between 450° C. and 560° C. If the forging start temperature is lower than 450° C., the deformation resistance becomes so large that the forging material cannot be molded completely and that there is a large work-strain due to forging left in a forged material, which leads to recrystallization being likely to occur. If the forging start temperature is higher than 560° C., such defects as a forging crack and eutectic melting are likely to occur in the forged material. The forging start temperature is appropriately determined according to such a parameter as a number of times forging is performed.

A forging end temperature of a forged material should be higher than or equal to 400° C. If the forging end temperature is lower than 400° C., there is a large work-strain due to forging left in the forged material and recrystallization is likely to occur in the forged material. The forging end temperature is set as high as possible to reduce the work-strain due to forging.

(Solution Treatment Process)

The solution treatment process S7 is a process to reduce the work-strain introduced by the forging process S6 and dissolve solute elements in the aluminum alloy. It is necessary to perform a solution treatment of heating the forged material at a solution treatment temperature between 500° C. and 560° C. for 3~8 hours in the solution treatment process S7. If the solution treatment temperature is below 500° C., solute elements are not dissolved completely in the matrix phase of the aluminum alloy forged material and the forged material is hardly strengthened by precipitation during ageing. If the solution treatment temperature is above 560° C. the eutectic melting and recrystallization are likely to occur although the ageing effect is obtained. It is not preferable to keep the forged material at the solution treatment temperature for less than 3 hours. If the forged material is kept at the solution temperature for less than 3 hours, the precipitated crystalline particles are not made finer and the tensile strength of the forged material does not increase, because the solution treatment is not homogeneously performed in the entire forged material. If the forged material is kept at the solution temperature for more than 8 hours, recrystallization is likely to occur because dispersed particles to prevent recrystallization from occurring become coarse or are gone.

In addition, a temperature rising speed for the solution treatment is preferably more than or equal to 60° C./hour.

The solution treatment may be carried out in such a furnace as the air furnace, the induction heating furnace or the salt bath.

(Quenching Process)

The quenching process S8 is a process in which the forged material after undergoing the solution treatment is quenched into water at a quenching temperature lower than or equal to 60° C. If the water temperature is higher than 60° C., a sufficient quenching effort to cool the forged material at a cooling speed needed to obtain the quenching effect is not obtained and there are coarse Mg—Si compound precipitates, which results in a sufficiently high tensile strength of the forged material being not obtained after the subsequent artificial ageing treatment process S9.

(Artificial Ageing Treatment Process)

The artificial ageing treatment is a process to perform an artificial ageing treatment of keeping the quenched forged material at an ageing temperature between 160 and 220° C. for 3~12 hours.

If the ageing temperature is lower than 160° C. or the ageing time is shorter than 3 hours, Mg—Si compound precipitates that contribute to increasing the tensile strength of the resultant material do not grow sufficiently. If the ageing temperature is higher than 220° C. or the ageing time is longer than 12 hours, the Mg—Si compound precipitates become so coarse that the effect to increase the tensile strength decreases.

The artificial ageing treatment may be performed in such a furnace as the air furnace, the induction heating furnace or an oil bath.

As has been explained, the aluminum alloy forged material that has both a high tensile strength and good corrosion resistance is obtained by performing on the aluminum alloy having the above mentioned composition each process of S1 to S9 whose process conditions are strictly controlled and constitute the production method of the present embodiment.

A peeling treatment may be performed after the melting and casting process S1 or after the homogenizing heat treatment process S2. Segregation phases can be formed on the surface of the cast material after the melting and casting process. Since these segregation phases contain a larger amount of the added elements than an inner portion of the cast material, the surface portion of the cast material becomes harder and more brittle. Therefore, in order to remove these segregation phases, the peeling treatment may be performed before a plastic forming process of the forging process S6.

WORKING EXAMPLE

Next, the present embodiment is explained based on test results of working examples of aluminum alloy forged materials which are within a scope of the present embodiment and comparison examples of aluminum forges materials which are out of the scope of the present embodiment. It should be noted that the present embodiment is not limited to the following working examples to be explained. The following properties have been evaluated for each of the working examples and the comparison examples.

(Alloy Composition)

The alloy compositions were measured with an optical emission spectrometer, OES-1014, which was produced by SHIMADZU Corporation. A measured portion of each sample was not predetermined.

(Tensile Test)

Figure 2A:
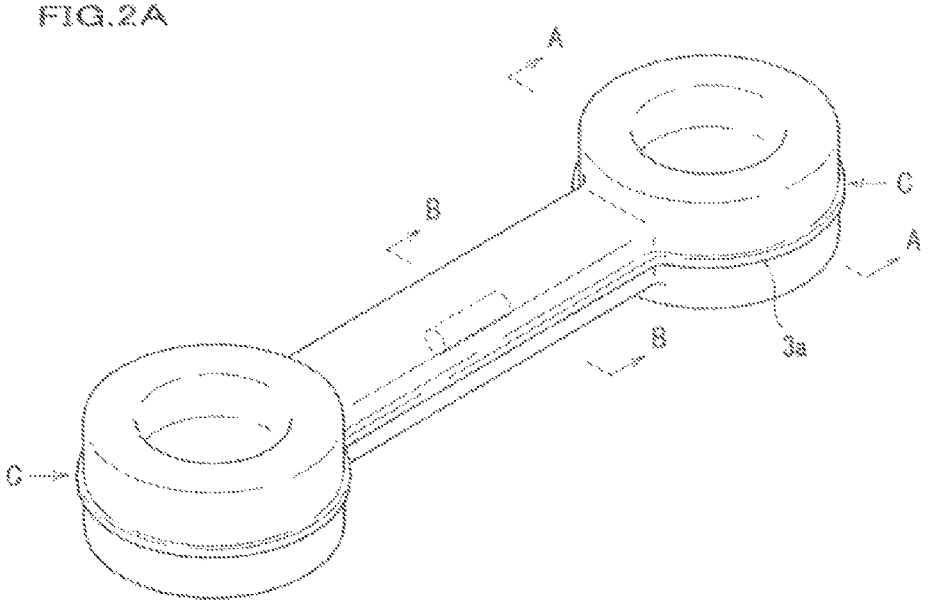
FIG. 2A is a figure schematically indicating positions of samples which are taken for measurement from each forged material of the working examples and the comparison examples.
Figure 2B:
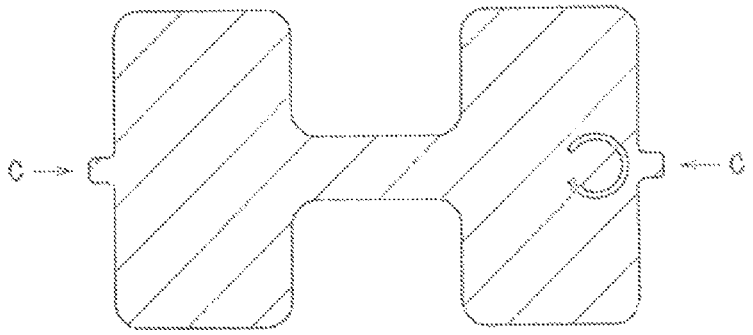
FIGS. 2B, 2C are cross section figures of each forged material of the examples in FIG. 2A inclusive of the samples.
Figure 2C:
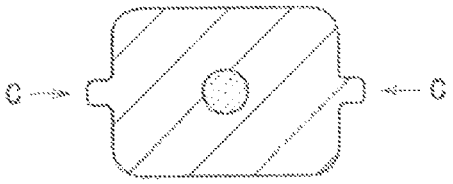

Tensile tests in accordance with a JIS Z2241 were performed on three test samples of each of the working examples and the comparison examples, winch corresponded to fourth test samples in accordance with JIS Z2201. For each test sample measured, a tensile strength, a 0.2% yield strength, and an elongation were measured. For each aluminum alloy forged material of the working examples and the comparison examples, average values of the tensile strength, the 0.2% yield strength, and the elongation were calculated. FIG. 2A indicates a portion of each aluminum alloy forged material of the working examples and the comparison examples, from which the test samples in accordance with the JIS fourth test sample were cut out for measuring tensile properties. FIG. 2C is a cross sectional view of the test sample of the aluminum alloy forged material when cut through a B-B line as indicated in FIG. 2A. In the B-B cut cross section, a cross section of a JIS fourth test sample for measuring tensile properties is indicated with a dotted area. A C-C line is a parting line through which the test sample was cut. The JIS fourth test sample for measuring tensile properties is taken from a center portion of each aluminum alloy forged material and a longitudinal direction of the JIS fourth test sample is in parallel with an extrusion direction in which the ingot was extruded. When the tensile strength was higher than or equal to 420 MPa, the 0.2% yield strength was higher than or equal to 370 MPa and the elongation was larger than or equal to 10.0% as a result of the tensile test, the tested aluminum alloy forged material was determined as good.

(Sensitivity to Stress Corrosion Cracking (SCC))

Figure 3A:
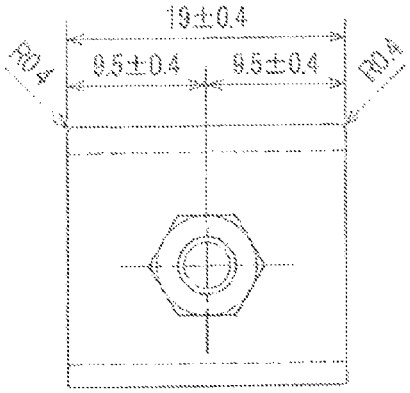
FIGS. 3A, 3B show dimensions of a stress corrosion cracking test sample (Coring test sample) used for the working examples and the comparison samples.
Figure 3B:
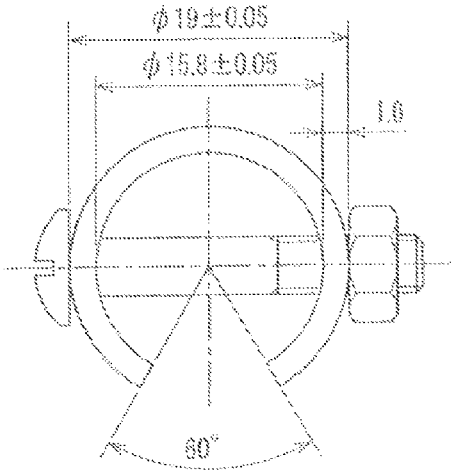

SCC tests in accordance with the alternate immersion method in ASTM G47 were carried out. C-ring test samples according to JIS H8711 were used for the SCC tests and made of the aluminum alloy forged materials that have been tested. FIG. 3A. and FIG. 3B are respectively a side view and an elevation view of the C-ring test sample for the SCC test, in which detailed dimensions are indicated. FIG. 2B shows a cross sectional view of the C-ring test sample on the A-A line cut cross section in the aluminum alloy forged material and a portion on the A-A line cut cross section from which the C-ring test sample for the SCC test is cut out.

For each aluminum alloy forged material, three SCC test samples were tested and a life of each sample to which a stress of 300 MPa is applied during the SCC test corresponds to a number of days for which the SCC test goes on before the sample cracks and was measured. The shortest life of the three SCC test samples is regarded as a life of the aluminum alloy forged material. When the life of the aluminum forged material was less than 30 days, the tested aluminum alloy forged material was classified as "no good". When the life of the aluminum alloy forged material was between 30 and 40 days, the tested aluminum alloy forged material was classified as "good". When the life of the aluminum alloy forged material was more than 40 days, the tested aluminum alloy forged material was classified as "excellent". The aluminum alloy forged materials which are classified as either "good" or "excellent" are determined as acceptable.

(Precipitated Crystalline Particle)

Precipitated crystalline particles were measured under the following condition.

FIG. 2C is a B-B line cut cross section view of the test sample of the aluminum alloy forged material as shown in FIG. 2A. In the B-B line cut cross section in FIG. 2C, a dotted area indicates a portion on the cross section at which precipitated crystalline particles were measured. The cross section of the test sample was etched with Keller Liquid for thirty seconds and a photo of the cross section having a magnification of 400 times was taken with an optical microscope.

FIG. 4 is a photo of one example showing precipitated crystalline particles on the cross section. The precipitated crystalline particle is seen black. Making an image analysis on this photo with image analysis software, an equivalent circle diameter for each precipitated crystalline particle was measured. A maximum value among the obtained equivalent circle diameters corresponds to the maximum equivalent circle ammeter in the photo. Similarly, measuring an area in the photo occupied by the precipitated crystalline particles and dividing the measured area by an area of the entire image, an area ratio of the precipitated particles in the photo was obtained. The maximum equivalent circle diameter of the precipitated crystalline particles for each tested aluminum alloy forged material was obtained by calculating an average value of twenty values for twenty magnified photos on view areas that were observed. Similarly, the area ratio of the precipitated crystalline particles for each tested aluminum alloy forged material was obtained.

The image analysis software used for this image analysis is WinRoof sold by Mitani corporation.

WORKING EXAMPLES 1-11, COMPARISON EXAMPLES 1-21

In FIG. 5, alloy compositions of aluminum alloys of which tested aluminum alloy forged materials are made are shown. The underlined element composition of the aluminum alloys of the comparison examples in FIG. 5 is out of the range of the corresponding element composition of the aluminum alloys of the present embodiment. A value following "<" indicates that the corresponding element composition is below the value. In this case the value after "<" indicates a detection limit of the measurement device used.

Various aluminum alloys of compositions as indicated in FIG. 5 before cast are respectively heated to 720° C. and cast at a casting speed of 30 mm/minute on the hot-top casting method. The obtained ingots have respectively a diameter of 300 mm. The ingots were heated to 540° C. at the heating speed of 1.5° C./minute, kept at 540° C. for 8 hours and cooled to lower than or equal to 300° C. at the cooling speed of 3° C./minute to perform the homogenizing treatment.

Subsequently, the ingots were heated to 520° C. in an air furnace and kept at 520° C. for 1.5 hours. Then each of the ingots was not cooled and immediately extruded to an extrusion molded material with a direct extrusion machine. The extrusion condition was as follows.

Extrusion temperature: 500° C., Extrusion ratio: 21.3, Extrusion speed: 3 m/minute The extrusion molded material was heated and kept at 520° C. for 1.5 hours. The extrusion molded material after the heat treatment was not cooled and immediately forged in the following forging process. In the forging process the extrusion molded material was hot-forged to an aluminum alloy forged material which was 70% thinner than the extrusion molded material before being forged through a mechanical forging process with an upper metal die and a lower metal die. The temperature of the extrusion molded material when the hot-forging started was 520° C. and the temperature of the aluminum alloy forged material when the hot-forging ended was 440° C.

Subsequently, the aluminum alloy forged material after forged was heated at 540° C. in an air furnace for 8 hours for a solution treatment, quenched into water at 60° C. to be cooled and then kept at 175° C. in the air furnace for 8 hours for an artificial ageing.

Tensile test samples for the tensile test and SCC test sample in the C-ring shape for measuring sensitivity to SCC, which are shown in FIGS. 2A, 2B and 2C, were taken from each of the obtained aluminum alloy forged materials. Using these test samples, tensile strengths, 0.2% yield strengths, elongations and sensitivity to SCC are measured for each of the obtained aluminum alloy forged materials. The measured results are shown in FIG. 6. The underlined measured results of the aluminum alloy forged materials in FIG. 6 are below corresponding criteria.

As is understood from FIG. 5 and FIG. 6, aluminum alloy forged materials working examples 1-11) that are made of aluminum alloys which are in accordance with claim 1 of the present embodiment have higher tensile strengths, higher 0.2% yield strengths and better stress corrosion cracking resistance than are required for practical use. On the other hand, each of aluminum alloy forged materials (comparison examples 1-21) that are made of aluminum alloys which are not in accordance with the present embodiment has at least one of the tensile strength, the 0.2% yield, strength and the stress corrosion cracking resistance which is below a required level for practical use.

(Working Examples 12-17, Comparison Examples 22-53)

The aluminum alloy of working example 3 in FIG. 5, which has a composition of 1.20 mass % of Si, 0.45 mass % of Fe, 0.07 mass % of Cu, 1.00 mass % of Mg, 0.02 mass % of Ti, less than 0.02 mass % of Zn, 0.65 mass % of Mn, 0.20 mass % of Cr, less than 0.01 mass % Zr, 0.15 ml/100 g Al of $H_2$, and a remainder of Al and inevitably contained elements, was used to produce various aluminum alloy forged materials (working examples 12-17 and comparison examples 22-53) in the same way as working examples 1-11 were produced according to production conditions indicated in FIGS. 7A, 7B. The production conditions other than those described in FIGS. 7A, 7B were the same as used for working examples 1-11. The underlined value of the production condition in FIGS. 7A, 7B is out of the range of the production condition in accordance with the present embodiment.

Tensile test samples and SCC test samples in the C-ring shape were taken from portions indicated in FIGS. 2A, 2B, 2C of each of the obtained aluminum alloy forged materials in the same way as done for working examples 1-11. The tensile strength, the 0.2% yield strength, the elongation and the stress corrosion cracking resistance are measured for each of the produced aluminum alloy forged materials in the same way as done for working examples 1-11.

FIG. 8 shows a table indicating measured properties of the aluminum alloy forged materials of working examples 12-17 and comparison examples 22-53. Underlined results of the aluminum alloy forged materials in FIG. 8 are below corresponding criteria.

As is understood from FIGS. 7A, 7B and FIG. 8, aluminum alloy forged materials (working examples 12-17) that are produced on the production conditions which are in accordance with claim 2 of the present embodiment have higher tensile strengths, higher 0.2% yield strengths and better stress corrosion cracking resistance than are required for practical use. On the other hand, each aluminum alloy forged materials (comparison examples 22-53) that are produced undergoing a process on a production condition which is out of the range to accordance with the present embodiment has at least one of the tensile strength, the 0.2% yield strength and the stress corrosion cracking resistance which is below a required level for practical use.

Figure 9A:
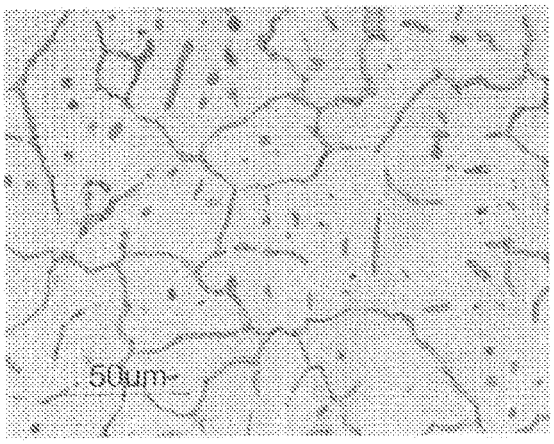
FIGS. 9A, 9B, 9C are photos each of which shows micro structures observed on a cross section of the aluminum alloy forged material of an embodiment after an intermediate production process and especially how precipitated crystalline particles exist and are dispersed.
Figure 9B:
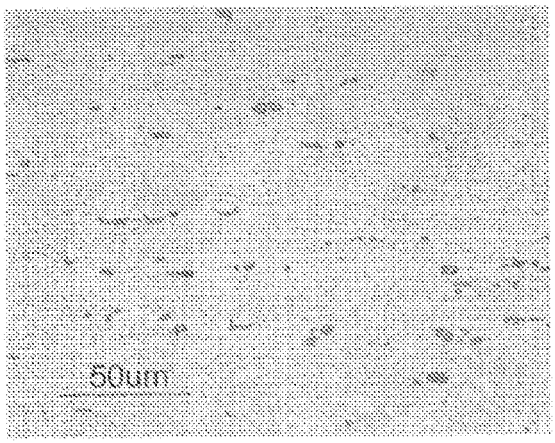
Figure 9C:
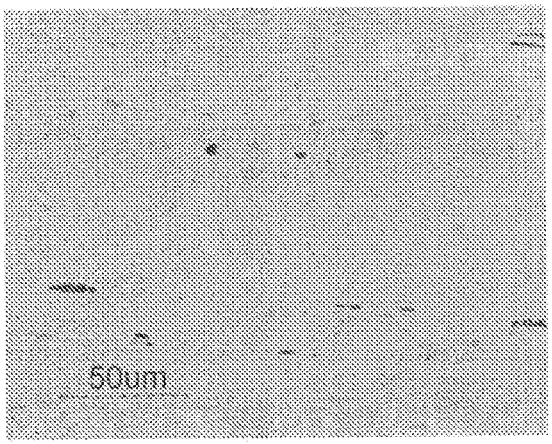

FIGS. 9A, 9B, 9C are photos each of which shows precipitated crystalline particles in the observed microstructure after an intermediate production process of the aluminum alloy from which working example 3 is produced in principle. In each photo, a scale for 50 μm is indicated.

FIG. 9A shows precipitated crystalline particles in the observed microstructure of the ingot after the melting and casting process S1.

FIG. 9B shows precipitated crystalline particles in the observed microstructure of the aluminum alloy forged material after the melting and casting process S1 and the homogenizing heat treatment process S2, the second heating process S5, the forging process S6, the solution treatment process S7, the quenching process S8 and the artificial ageing treatment process S9 were performed without the first heating process S3 and the extruding process to be performed.

FIG. 9C precipitated crystalline particles in the observed microstructure of the aluminum alloy forged material which was produced on the same production conditions from the melting and casting process through to the artificial ageing process as working example 3.

As seen from the photo in FIG. 9A, the ingot after the melting and casting process S1 has a lot of precipitated crystalline particles which are precipitated so as to look like a net. Comparing the photo in FIG. 9B which shows precipitated crystalline particles of the aluminum alloy forged material produced without the extruding process S3 performed from the ingot whose microstructure is shown in FIG. 9A with the photo in FIG. 9C which shows precipitated crystalline particles of the aluminum alloy forged material produced with the extruding process S3 performed from the ingot whose microstructure is shown in FIG. 9A, it should be understood that an amount of the precipitated crystalline particles decreased by performing the extruding process S3 and that the precipitated crystalline particles become finer by performing the extruding process S3. Since the aluminum alloy forged material of the present embodiment has a smaller amount of the precipitated crystalline particles that are made finer, recrystallization in the material during the production process is suppressed and the tensile strength of the aluminum alloy forged material becomes higher.

Figure 10:
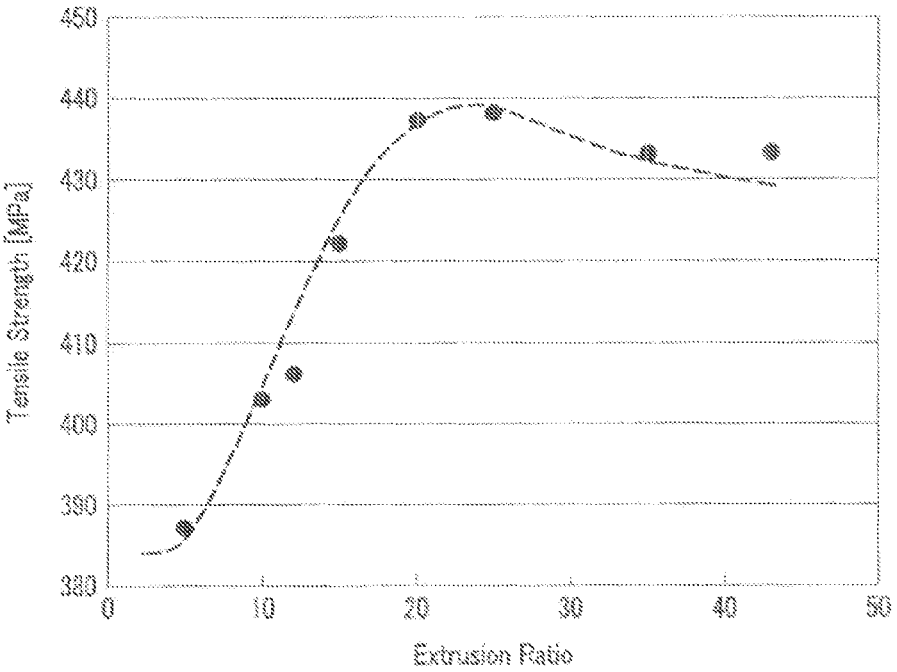
FIG. 10 is a graph in which the tensile strength is plotted with respect to the extrusion ratio.

FIG. 10 shows measured tensile strengths of aluminum alloy forged materials with respect to the extrusion ratio. The aluminum alloy forged materials were produced on the sane production conditions as working example 3 except for the extrusion ratio, and among the aluminum alloy forged materials the extrusion ratio was varied. Looking at FIG. 10, the tensile strength drastically increases up to the extrusion ratio of 20 and that the local maximum tensile strength is obtained between the extrusion ratios of 15 and 25. It should be understood that the aluminum alloy forged materials with high tensile strengths are obtained if the aluminum alloy materials are extruded at the extrusion ratio between 15 and 25.

What is claimed:

1. An aluminum alloy forged material, comprising aluminum, and by mass percent:

from 0.6~1.2% of Mg;

from 0.7~1.5% of Si;

from 0.1~0.5% of Fe;

from 0.01~0.1% of Ti;

from 0.3~1.0% of Mn;

at least one of 0.1~0.4% of Cr and 0.05~0.2% of Zr;

a restricted amount of Cu that is less than or equal to 0.1%;

a restricted amount of Zn that is less than or equal to 0.05%; and a restricted amount of H that is less than or equal to 0.25 ml in 100 g Al, wherein the aluminum alloy forged material includes precipitated crystalline particles among which a largest precipitated crystalline particle has a maximum equivalent circle diameter of less than or equal to 8 μm and has a tensile strength larger than or equal to 420 MPa, and an area ratio of the precipitated crystalline particles is equal to or less than 3.6%.

2. A method for producing an aluminum alloy forged material having precipitated crystalline particles among which a largest precipitated crystalline particle has a maximum equivalent circle diameter of less than or equal to 8 μm and has a tensile strength larger than or equal to 420 MPa, and an area ratio of the precipitated crystalline particles is equal to or less than 3.6%, the method comprising in the following order:

a melting and casting process of melting an aluminum alloy to a melting temperature between 700° C. and 780° C. and casting the melt aluminum alloy to an ingot;

wherein the aluminum alloy comprises aluminum, and by mass percent: from 0.6-1.2% of Mg; from 0.7-1.5% of Si; from 0.1-0.5% of Fe; from 0.01-0.1% of Ti; from 0.3-1.0% of Mn; at least one of 0.1-0.4% of Cr and 0.05-0.2% of Zr; a restricted amount of Cu that is less than or equal to 0.1%; a restricted amount of Zn that is less than or equal to 0.05%; and a restricted amount of H that is less than or equal to 0.25 ml in 100 g Al, a homogenizing heat treatment process of heating the ingot at a temperature rising speed that is equal to or higher than 1.0° C./minute, keeping the ingot between 470° C. and 560° C. for 3-12 hours and cooling the ingot to a temperature lower than or equal to 300° C. at a temperature lowering rate equal to or higher than 2.5° C./minute;

a first heating process of heating the ingot between 500° C. and 560° C. for 1.5 hours;

an extruding process of extruding the ingot at an extrusion speed of 3-15 m/minute and at an extrusion ratio between 15 and 25 to an extruded material while a temperature of the ingot is between 450° C. and 540° C.;

a second heating process of heating the extruded material between 500° C. and 560° C. for 1 hour;

a forging process of forging the extruded material that is heated to a forging start temperature between 450° C. and 560° C. to a forged material in a desired shape at a forging end temperature higher than or equal to 400° C.;

a solution treatment process of performing a solution treatment of heating the forged material at a solution treatment temperature between 500° C. and 560° C. for 3-8 hours;

a quenching process of quenching the forged material at a quenching temperature lower than or equal to 60° C., and an artificial ageing treatment process of keeping the forged material at an ageing temperature between 160° C. and 220° C. for 3-12 hours.

* * * * *